United States Patent [19]

Salvagnini

[11] Patent Number: 4,650,114

[45] Date of Patent: Mar. 17, 1987

[54] PUNCH PRESS WITH A NUMBER OF SELECTABLE PUNCHES

[75] Inventor: Guido Salvagnini, Sarego, Italy

[73] Assignee: Salvagnini Transferica S.p.A., Sarego, Italy

[21] Appl. No.: 801,936

[22] Filed: Nov. 26, 1985

[30] Foreign Application Priority Data

Nov. 28, 1984 [IT] Italy ..... 23773 A/84

[51] Int. Cl.[4] ..... B26F 1/04

[52] U.S. Cl. ..... 234/114; 83/409; 83/513; 83/543; 83/571; 234/116; 234/119

[58] Field of Search ..... 234/111-119, 234/97-101, 109; 83/571-573, 409, 513, 543

[56] References Cited

U.S. PATENT DOCUMENTS 2,836,245 5/1958 Welsh ..... 234/117

4,260,102 4/1981 Thoma ..... 234/117 X

*Primary Examiner*—James M. Meister

*Attorney, Agent, or Firm*—Cushman, Darby & Cushman

[57] ABSTRACT

Between a plurality of side-by-side punches and an operating slide having reciprocating motion is arranged a selective motion transmission device which consists of two pluralities of toothed couplings in mutually opposed positions. The toothed couplings of a first plurality are made integral with the punches while the others follow the reciprocating motion of the slide but are shiftable transversally to it between a neutral position and a working position. In the latter position the teeth of the opposed couplings are mutually aligned and thus allow transmission of the reciprocating motion of the slide to the corresponding punches.

10 Claims, 11 Drawing Figures

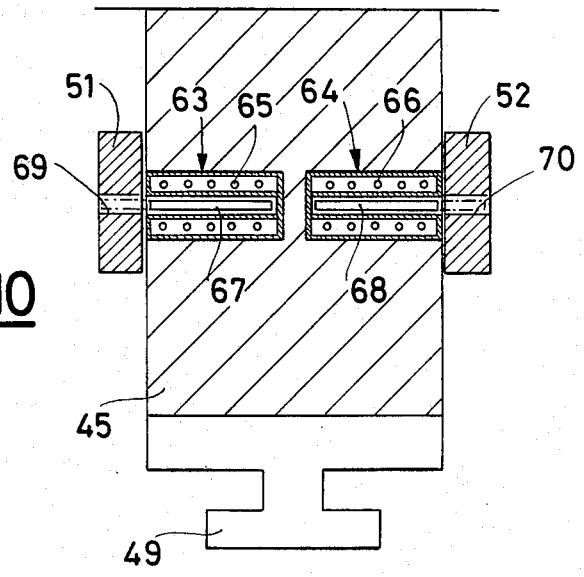
Fig. 10
Fig. 9
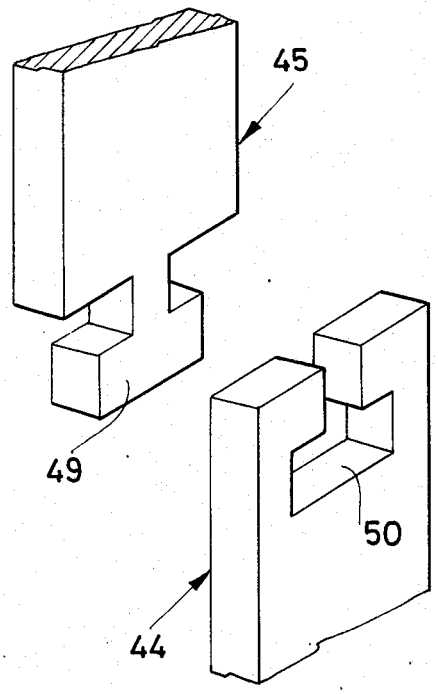
Fig. 11
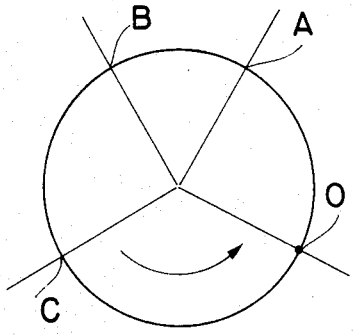

PUNCH PRESS WITH A NUMBER OF SELECTABLE PUNCHES

The present invention relates to a punch press equipped with a number of selectable punches.

There is a known tendancy to concentrate in a single machine a plurality of independently operating punches.

It is also known that a concentration of this type can secure specific advantages from the employment of an element supplying movement for the entire series of punches with selective transmission or nontransmission of movement to one and/or another of said punches.

The object of the present invention is to achieve a punch press with a number of selectable punches in which a single drive motor operates all the punches selectively and separately.

In accordance with the invention said object is achieved by a punch press with a number of punches characterized in that in includes a slide with reciprocating vertical motion for the operation of said punches and, arranged between said slide and said punches, a selective motion transmission device consisting of a plurality of primary toothed couplings and a corresponding plurality of secondary toothed couplings faced toward and opposing the primary ones, said primary toothed couplings being made integral with said punches and said secondary toothed couplings being made integral with said slide to secure said reciprocating vertical motion but movable transversally with respect thereto between a neutral position wherein the teeth of the secondary couplings are not aligned with those of the primary couplings so that the motion of the slide has no effect on the punches and a working position in which the teeth of the secondary couplings are aligned with those of the primary couplings for transmission of reciprocating motion of the slide to the related punches, there being provided devices for selective control of the transversal shifting of said secondary couplings to secure the corresponding selection of the punches designed to follow said reciprocating motion of the slide.

In other words, by a mere selective shifting of the toothed couplings it becomes possible to select the punches from time to time destined to receive drive motion transmitted by the slide, i.e. by a single appropriately controlled drive member. The design is simple and at the same time lends itself to easy control for automatic performance of the punching operations.

These and other features of the present invention will be made clear by the following detailed description of a practical embodiment thereof illustrated as a nonlimiting example in the annexed drawings wherein:

FIG. 9 shows a further enlarged perspective of the detail of the engagement which can be made between the teeth of the toothed couplings which make up said transmission device;

FIG. 10 shows an enlarged cross section along plane of cut X—X of FIG. 6 of the detail of the coupling parts which make possible selective shifting of said toothed couplings between the neutral and working positions;

FIG. 11 shows an illustrative diagram of the operating cycle of the motion transmitting device.

Figure 1:
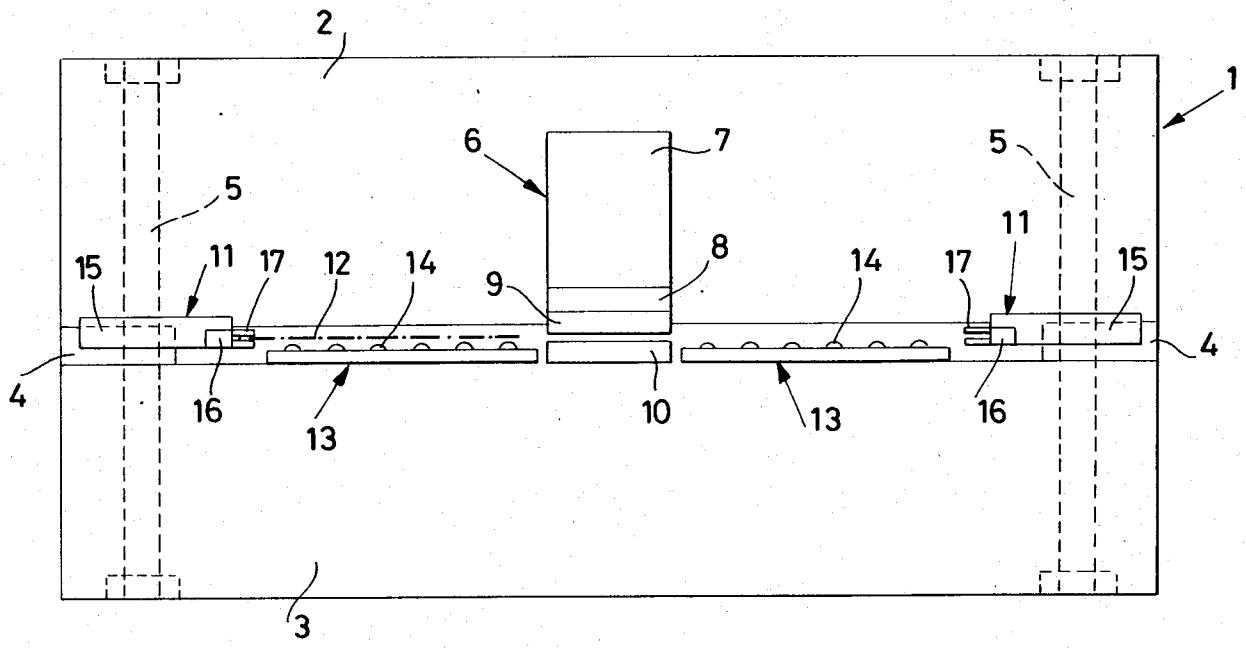
FIG. 1 shows a front view of a press in accordance with the invention.
Figure 2:
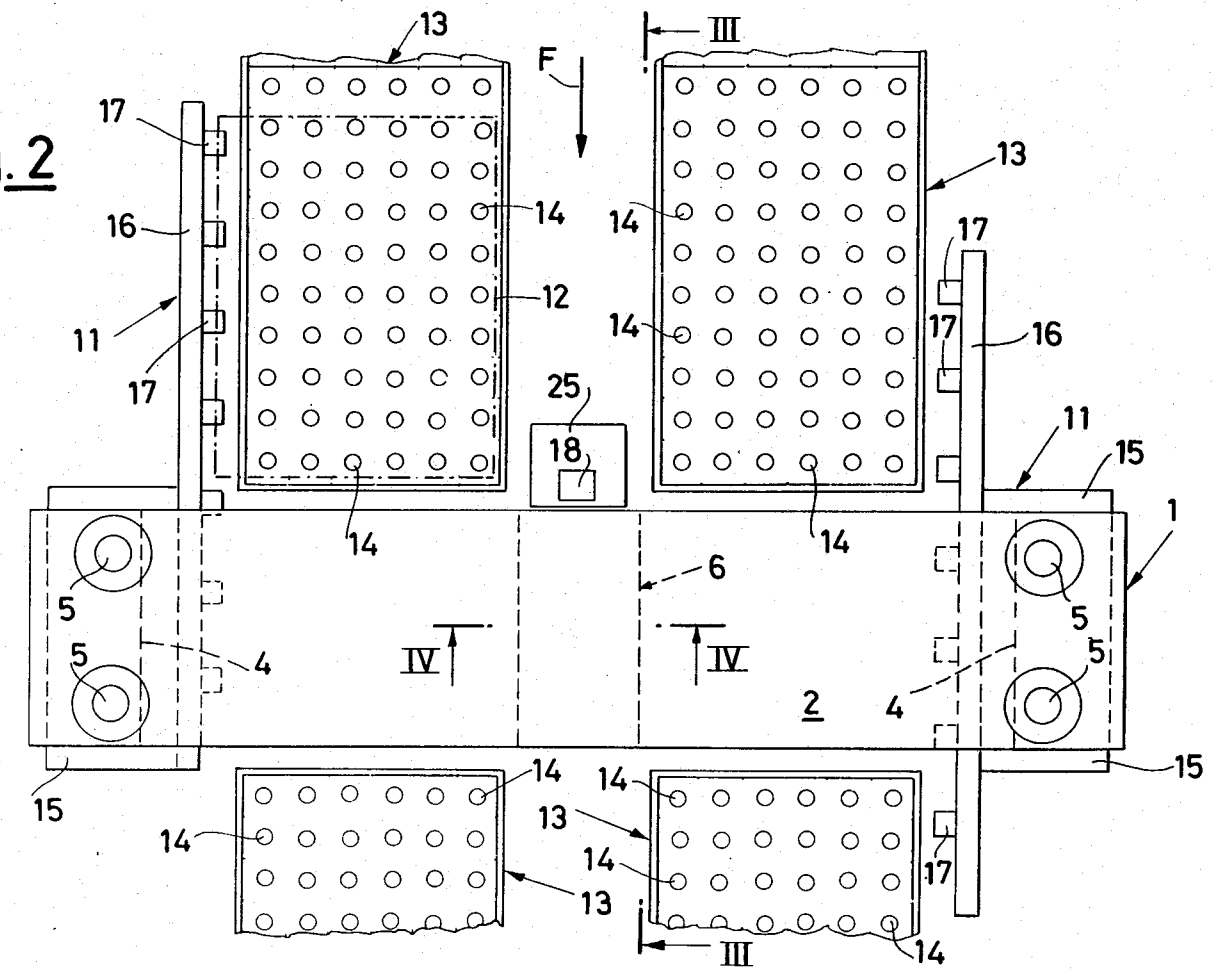
FIG. 2 shows a top view of said press.
Figure 3:
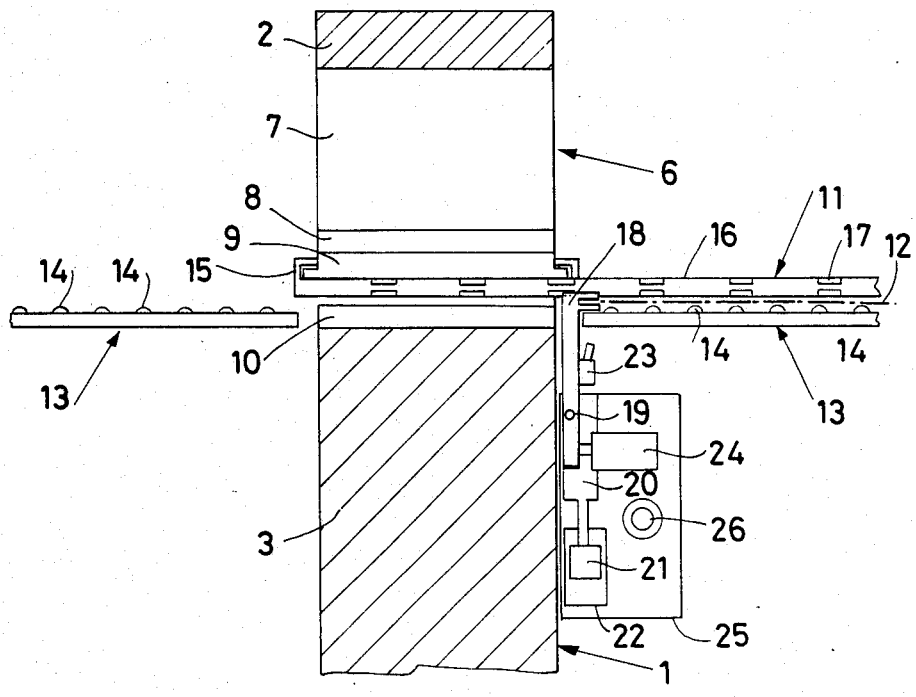
FIG. 3 shows a cross section along plane of cut III—III of FIG. 2.

As shown in FIGS. 1-3 the punch press illustrated in the drawings has a portal-type general structure 1 consisting of an upper beam 2, a lower beam 3, and two spacers 4 compressed by internal connecting columns 5.

In the centre of the portal structure is arranged an operating head 6 consisting of a punching-motion control unit 7, a selective motion transmission unit 8, a punch unit 9, and a die unit 10.

With the portal structure 1 at the two sides of the operating head 6 are associated two numerically controlled manipulators 11 which handle the metal sheets 12 during the punching operations, making use of the support of the sheet metal on fixed table tops 13 fitted with balls or other rolling elements 14 of the disappearing type. Table tops of this type are well known and therefore will not be described in detail here Each manipulator 11 consists of a carriage 15 which runs along the upper beam 2 and of a cross bar 16 which runs perpendicularly to the path of the carriage 15 and bears a series of grippers 17 for grasping the metal sheet.

Between the two manipulators 11, on the arrival side of the metal sheet (arrow F in FIG. 2) a disappearing gripper 18 is also provided to act as a striker for the arriving metal sheet and as a means of transport for transferring the metal sheets from one of the two manipulators to the other (as will be explained better below).

As shown in FIG. 3 the gripper 18 has a fulcrum at 19 on a vertical sliding support 20 made integral with the stem of a piston 21 sliding in a cylinder 22. Two feelers 23 and 24 are capable of feeling the inclination and the descent of the gripper 18 with respect to the normal waiting position of FIG. 3. The entire assembly described is also supported by a carriage 25 which runs horizontally along the lower beam 3 propelled by a motor-driven screw 26.

Figure 4:
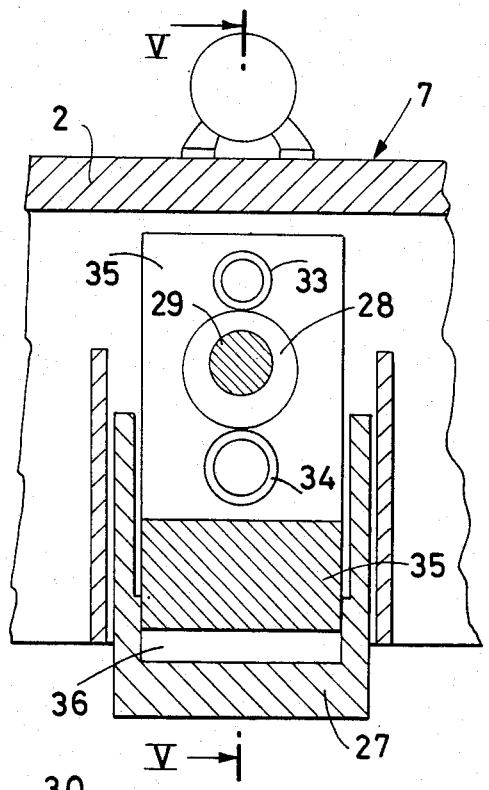
FIG. 4 shows a cross section along plane of cut IV—IV of the enlarged detail of FIG. 2 of the slide control device which is included in the press of the preceding figure.
Figure 5:
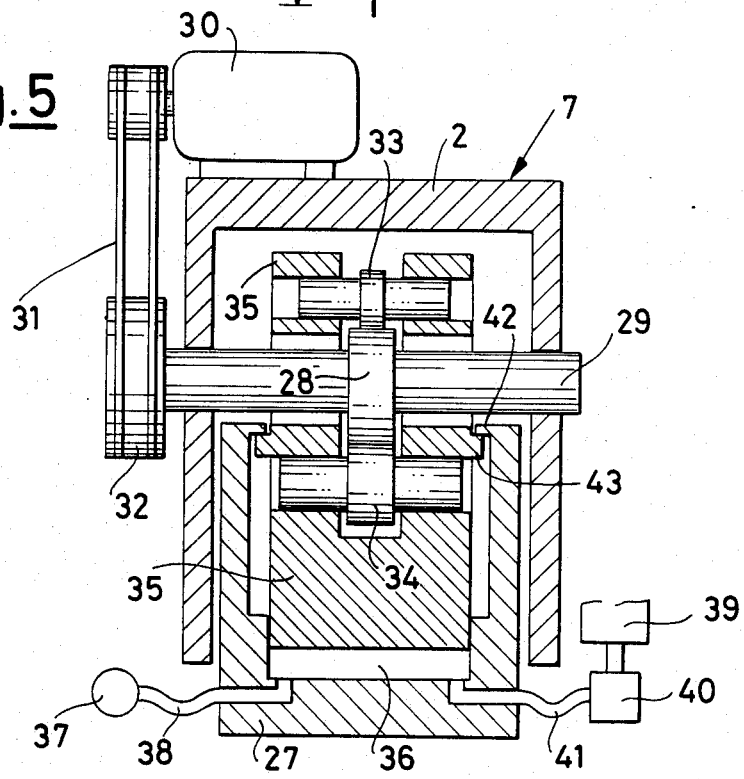
FIG. 5 shows a cross-section along plane of cut V—V of said control device of FIG. 4.

The punching motion drive unit 7 is shown in detail in FIGS. 4 and 5 and comprises a slide 27 running vertically in the upper beam 2 of the portal structure 1. The slide 27 is subjected to reciprocating vertical motion (approximately two centimeters of travel) by a desmodromic cam 28 mounted on a shaft which is made to rotate by a variable-speed electric motor 30 through a belt transmission 31 with a reciprocating wheel 32. With the desmodromic cam 28 cooperate from opposite sides two idling feeler rollers 33 and 34 both born in a rotating manner by a support 35 which is housed in a sliding manner inside the slide 27, describing a chamber 36 kept constantly full of oil by a pump 37 connected to the slide 27 by a flexible tube 38. The chamber 36 acts as a safety device against overloading because if the descent force transmitted by the cam 28 to the slide 27 exceeds the maximum acceptable value the oil issues from the chamber 36 to a tank 39 through a maximum pressure valve 40 and a flexible tube 41, thus allowing rotation of the cam 28 even though the slide 27 stops. The striker engagement between the two projecting parts 42 and 43 of the slide 27 and the support 35 also allows travel of said slide 27 integrally with said support 35 on the upward return stroke.

As shown in FIG. 4 the cam 28 is designed in such a manner as to allow the slide 27 to remain stationary at top dead centre for a certain cam rotation angle. It is during this pause that the punches are selected in the motion transmission unit 8 for the subsequent descent stroke of the slide.

Figure 6:
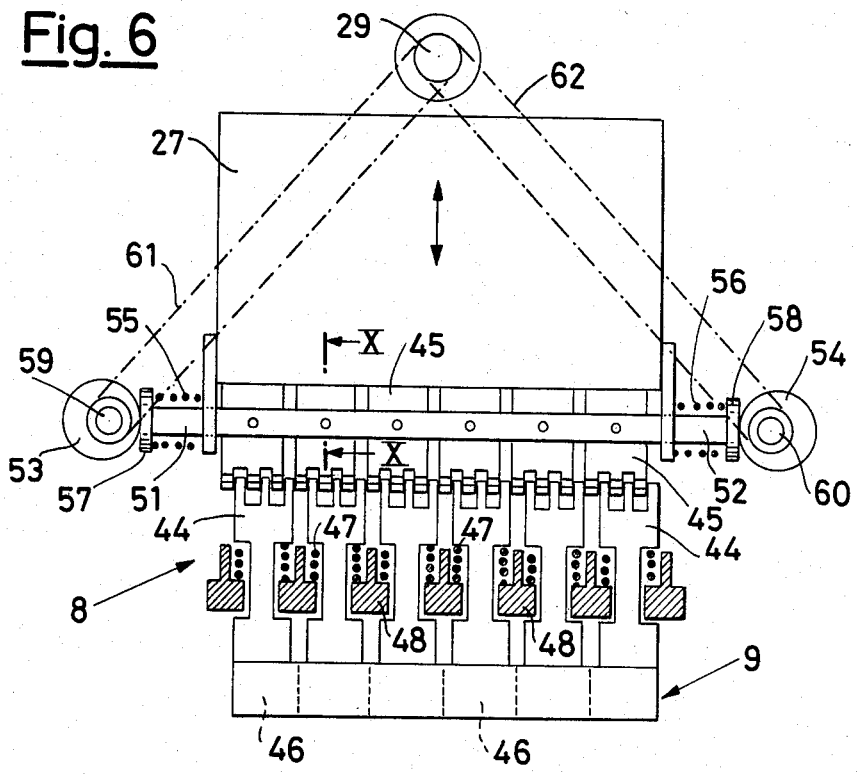
FIG. 6 shows a front view of the enlarged detail of the selective motion transmission device which is included in the press of FIGS. 1-3, the device being shown in neutral position.
Figure 7:
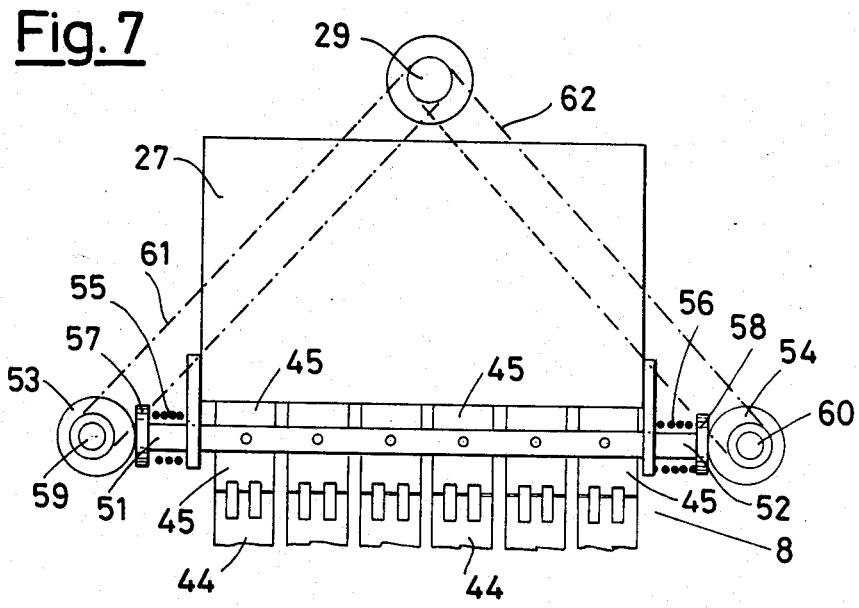
FIG. 7 shows said transmission device in working position.

The selective motion transmission unit 8 is illustrated in detail in FIGS. 6–10 relative to a matrix arrangement of punches of the punch unit 9. It comprises a punch selection device made up essentially of two superimposed pluralities of primary and secondary toothed couplings 44 and 45 mounted with teeth (eight or nine in the actual construction) turned upward and downward respectively (FIG. 6). The primary toothed couplings 44 are made integral with corresponding punches 46 (indicated schematically) of the punch unit 9 and are elastically stressed together with them toward the raised neutral position of FIG. 6 by the springs 47 which react between the primary toothed couplings 44 and the fixed tappets 48. The secondary toothed couplings 45 are in turned constrained by the slide 27 as concerns the vertical movement of the latter but are also movable transversally for a few millimeters between the neutral position of FIG. 6 in which the teeth of the secondary toothed couplings 45 are inserted between those of the lower couplings 44 and the working (or selection) position of FIG. 7 in which the teeth of the secondary toothed couplings 45 are aligned and engaged with those of the primary toothed couplings 44, the engagement being accomplished by overturned T appendages 49 of the teeth of the secondary toothed couplings 45 engaged in corresponding complementary recesses 50 of the teeth of the primary toothed couplings 44 as can be seen in FIG. 9. It appears clear that with the upper secondary toothed couplings 45 in the neutral position of FIG. 6 the reciprocating movement of the slide 27 is an idle stroke, i.e. it is not accompanied by an analogous movement of the punches 46, while with said upper toothed couplings in the working position of FIG. 7 the reciprocating motion of the slide is transmitted to the punches 46, which thus perform the punching of the metal sheet in collaboration with the underlying dies of the die assembly 10.

Figure 8:
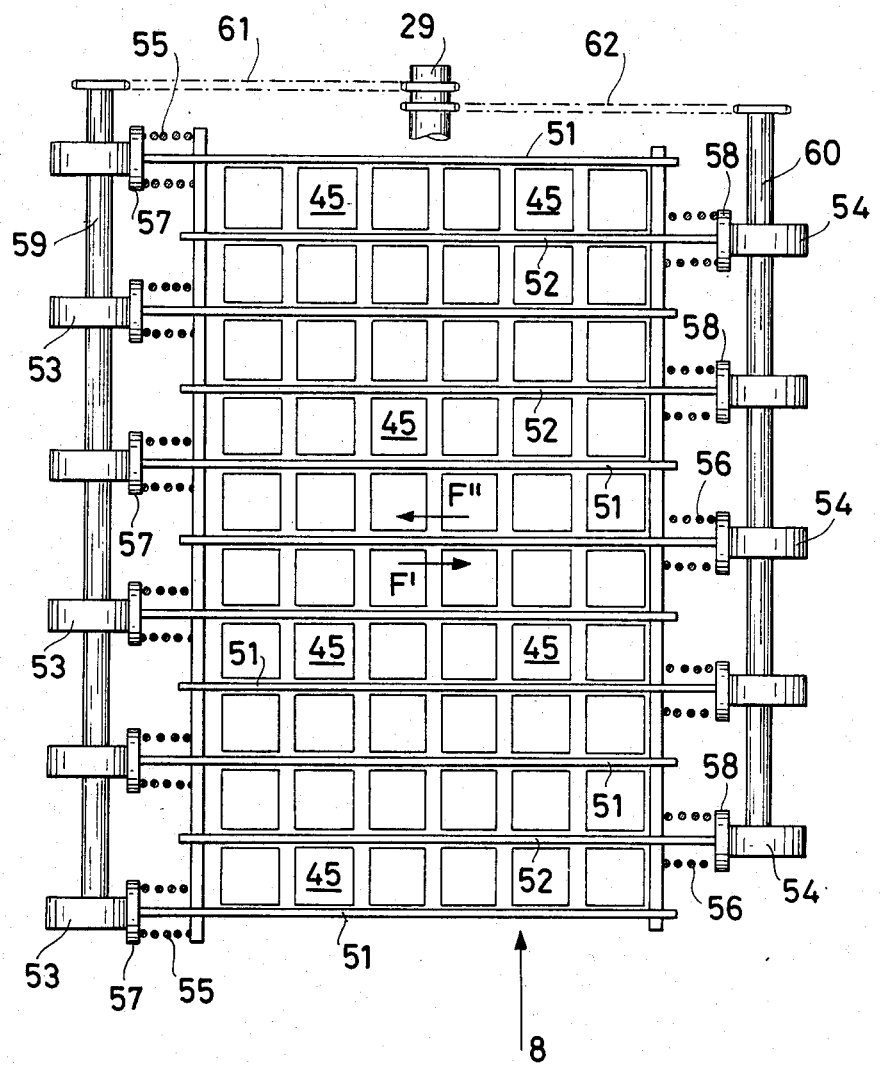
FIG. 8 shows a top view of said transmission device, still in the neutral position.

Each of the upper secondary toothed couplings 45 is independently selectable in either of the aforesaid positions by means of a plurality of actuating rods 51 and deactuating rods 52, which alternate at the two sides of each row of secondary toothed couplings 45 and hence of the punches 46 (FIG. 8). Moving in the direction indicated by the arrow F' in FIG. 8, the rods 51 shift the secondary toothed coupling or couplings selected 45 from the neutral position of FIG. 6 to the working position of FIG. 7. Moving in turn in the direction indicated by the arrow F'' in FIG. 8, the rods 52 also shift one or more secondary toothed couplings 45 from the working position of FIG. 7 to the neutral position of FIG. 6.

The reciprocating movement of the rods 51 and 52 in the two directions indicated by the arrows F' and F'' in FIG. 8 is provided by sets of cams 53 and 54 respectively with which they are held in contact by springs 55 and plates 57 and 58 respectively which are integral with the rods 51 and 52. The two sets of cams 53 and 54 are mounted on shafts 59 and 60 respectively which are connected by chains 61 and 62 to the main shaft 29, which gives motion to the slide 27 (FIGS. 4 and 5.) The profile of the cams 53 and 54 is such that it causes the rods 51 and 52 to perform a stroke equal to one space between successive teeth of the secondary toothed couplings 45 in the time in which the slide 27 is stopped at top dead centre. The return stroke of the rods 51 and 52 is accomplished in a longer time during the movement of the slide 27.

The various secondary toothed couplings 45 are engaged with and disengaged from the rods 51 and 52 in a selective manner for the ensuing movement to and from the working position thanks to coupling devices such as those shown in FIG. 10, which are associated with each secondary toothed coupling 45. Said devices consist of electromagnets 63 and 64 housed in corresponding recesses in the secondary toothed coupling 45 and are fitted with electrical coils 65 and 66 and with mobile keepers consisting of sliding pins 67 and 68 which are capable of protruding from their respective electromagnets to engage in aligned holes 69 and 70 of the rods 51 and 52 as shown in broken lines in FIG. 10. In this manner the various secondary toothed couplings 45 can be disengaged from both the rods 51 and 52 or can be engaged with their respective rods 51 and not with the rods 52, and vice versa. If they are constrained by one or the other of the aforesaid rods the secondary toothed couplings 45 follow the movement thereof due to the ensuing selection shift between the neutral position of FIG. 6 and the working position of FIG. 7. Excitation of the electromagnets 63 and 64 is synchronized with the rotation of the cams 53 and 54 and hence with the reciprocating motion of the slide 27 in such a manner as to constrain the secondary toothed couplings 45 selected by the rods 51 and 52 immediately before the forward strokes of the rods (arrows F' and F'' of FIG. 8) and hence during the pauses in the reciprocating motion of the slide 27, to then free them at the end of said forward movements and for the entire period of fall and rise of the slide 27. The return movement of the rods 51 and 52 thus takes place while said rods are unconstrained by the secondary toothed couplings 45. The operating cycle described is represented visually in FIG. 11 wherein O represents the cycle starting point and the arcs O-A, A-B, B-C and C-O indicate the time of engagement of the rods 51 and 52, forward stroke time of said rods, disengagement time, and return movement time respectively. The slide 27 in turn remains stationary for time A-B and performs the fall and rise movement in the remaining time B-C-O-A.

General operation of the punch press illustrated in the drawings can be described thus: a metal sheet 12 is fed in the direction of the arrow F of FIG. 2 until it strikes against the gripper 18. If the sheet is not sufficiently wide, the gripper 18 closes and under control of the screw 26 the gripper 18 shifts the metal sheet toward one of the manipulators 11, e.g. the left one in FIG. 2. The grippers 17 close, the gripper 18 opens, and then the piston 21 commands it to disappear below the work surface in such a manner as not to obstruct subsequent movements of the metal sheet controlled by said manipulator 11.

The balls 14 of the supporting tables 13 being of the disappearing type, the manipulator 11 can move freely with respect to the portal structure 1 (in the two perpendicular directions of movement of the carriage 15 and the bar 16) to position the metal sheet 12 as required from time to time with respect to the punch unit 9 and the underlying die assembly 10. Positioning of the metal sheet takes place when the punches do not move, i.e. in the time when no secondary toothed coupling 45 is in the working position. More precisely, by excitation of appropriate electromagnets 64 and 63 the secondary toothed couplings 45 previously in working position are brought back to neutral position by the rods 52 while other toothed couplings previously idle are shifted to the working position by the rods 51. In this manner new punches 46 are selected and pierce the metal sheet at the desired points. Positioning of the metal sheet and selection of the punches takes place in accordance with a precise punching programme previously inserted in the press control unit.

Not all the metal sheet can be punched using a single manipulator because, particularly if the sheet is small, the manipulator grippers are not capable of bringing the most marginal points under the appropriate punches. To complete punching it is therefore necessary to transfer the metal sheet from one manipulator to the other, again using for this purpose the disappearing gripper 18. While the second manipulator progressively positions the metal sheet, repeatedly shifting it toward the front of the portal structure 1, the primary manipulator can go and take a new sheet and start the punching operation. The control unit prevents interference between the two metal sheets, thus allowing simultaneous punching of two sheets.

I claim:

1. Punch press with a number of selectable punches characterized in that it comprises a slide with continuous reciprocating vertical motion for operation of said punches and, arranged between said slide and said punches, a selective motion transmission device made up of a plurality of primary toothed couplings and a corresponding plurality of secondary toothed couplings opposed to the primary toothed couplings, said primary toothed couplings being made integral with said punches and said secondary toothed couplings being made integral with said slide for said reciprocating vertical motion but shiftable transversally with respect to it between a neutral position in which the teeth of the secondary couplings are not aligned with those of the primary couplings, so that the motion of the slide has no effect on the punches, and a working position in which the teeth of the secondary couplings are aligned with those of the primary couplings for transmission of the reciprocating motion of the slide to the corresponding punches, devices being provided for selectively shifting said secondary toothed couplings to secure the corresponding selection of the punches which are to follow said reciprocating motion of the slide.

2. Punch press is accordance with claim 1 characterized in that said primary and secondary toothed couplings are provided with releasable devices to secure their mutual engagement in the working position.

3. Punch press in accordance with claim 2 characterized in that said releasable devices consist of shaped appendages of the teeth of the primary and secondary couplings and of complementary shaped recesses of the teeth of the opposing couplings.

4. Punch press in accordance with claim 1 characterized in that said devices controlling the transversal shifting of the secondary toothed couplings comprise a plurality of actuation rods and deactuation rods with reciprocating motion selectively and releasably engageable with said secondary toothed couplings to bring about shifting to the working position and return to the neutral position respectively.

5. Punch press in accordance with claim 4 characterized in that said secondary toothed couplings comprise releasable engagement devices for engagement with said actuation and deactuation rods, said devices consisting of electromagnets equipped with movable keepers which can be engaged in holes made in said rods.

6. Punch press in accordance with claim 4 characterized in that the vertical reciprocating motion of the slide is secured in such a manner as to provide a temporary stop of the slide at its top dead centre point and in that the reciprocating motion of said actuation and deactuation rods and their releasable engagement are synchronized with the motion of the slide in such a manner that shifting of said secondary toothed couplings to and from the working position takes place during said temporary stop of the slide.

7. Punch press in accordance with claim 6 characterized in that said slide is driven to accomplish said vertical reciprocating motion by a revolving cam with which cooperate feeler rollers fixed in a turning manner to a support housed in a sliding manner inside the slide, there being between said support and said slide a chamber filled with oil.

8. Punch press in accordance with claim 7 characterized in that said oil chamber communicates with a drain tank through a maximum pressure valve.

9. Punch press in accordance with claim 1 characterized in that it comprises two manipulators arranged at opposite sides of the punch unit, a first manipulator being designed to receive the metal sheet to be punched and position it for a first series of punching operations and the second manipulator being designed to receive the metal sheet from said first manipulator and position it for a second series of punching operations.

10. Punch press in accordance with claim 9 characterized in that it also comprises a disappearing gripper arranged between said two manipulators to receive the metal sheet to be punched and bring it to the first manipulator and then transfer the metal sheet from the first manipulator to the second manipulator after performance of the first series of punchings, if the sheet is not wide enough.

* * * * *